United States Patent [19]

DeMars

[11] Patent Number: 4,791,030

[45] **Date of Patent: * Dec. 13, 1988**

[54] SUPER HERO CUP HOLDER

[76] Inventor: Robert A. DeMars, 7932 Maestro Ave., Canoga Park, Calif. 91304

[ * ] Notice: The portion of the term of this patent subsequent to Mar. 31, 2004 has been disclaimed.

[21] Appl. No.: 31,247

[22] Filed: Mar. 26, 1987

Related U.S. Application Data

[63] Continuation-in-part of Ser. No. 739,564, May 30, 1985, Pat. No. 4,654,274.

[51] Int. Cl.[4] ..... B65D 25/28

[52] U.S. Cl. ..... 428/542.4; 215/100 A; 220/94 R; 220/96; 248/310; 248/311.2; 428/16

[58] Field of Search ..... D7/70; 215/100 A; 220/94 R, 96; 248/DIG. 8, 310, 311.2; 428/16, 542.4

[56] References Cited

U.S. PATENT DOCUMENTS

| | | | |
|---|---|---|---|
| D. 187,501 | 3/1960 | Hagenes | 428/16 X |
| D. 209,533 | 12/1967 | Cole et al. | D7/70 |
| D. 265,880 | 8/1982 | Craig | D7/70 |
| D. 285,274 | 8/1986 | DeMars | D7/70 |
| 2,070,414 | 2/1937 | Snell | 428/131 X |
| 2,801,743 | 8/1957 | Geen | 220/94 R X |
| 2,838,202 | 6/1958 | Huether | 220/94 R X |
| 2,933,280 | 4/1960 | Hard | 428/16 X |
| 3,029,975 | 4/1962 | Aiello | D7/70 X |
| 3,458,164 | 7/1969 | Massey | D7/70 X |
| 3,592,501 | 7/1971 | Stokes et al. | D7/70 X |
| 3,825,151 | 7/1974 | Arnaud | 220/94 R |
| 4,273,816 | 6/1981 | Tollette | 428/187 X |
| 4,654,274 | 3/1987 | DeMars | 428/542.4 |

*Primary Examiner*—Henry F. Epstein
*Attorney, Agent, or Firm*—Cislo & Thomas

[57] ABSTRACT

A cup holder having a cylinder portion for receiving a cup which has no handles and a releasable handle therefor. The releasable handle has a shank, one or more extensions from the upper portion of the shank and a platform at the base of the shank. On the distal end of each extension, there are receptacles for releasably engaging a protrusion on a horizontal surface of an outwardly extending ledge on the upper portion of the cylinder. The platform has means for releasably receiving a lip in the lower rim of the cylinder.

7 Claims, 2 Drawing Sheets

SUPER HERO CUP HOLDER

CROSS-REFERENCE TO RELATED APPLICATION

This application is a continuation-in-part application of my co-pending application Ser. No. 06/739,564, now U.S. Pat. No. 4,654,274, which was filed on May 30, 1985.

BACKGROUND OF THE INVENTION

The present invention pertains to cup holders which are especially useful for association with the type of cups which one usually encounters in fast food restaurants, at sports stadiums, and at other outside attractions. These are usually disposable paper cups which are without handles and have frusto-conical sidewalls; the bottom is usually recessed. The cup holder of the present invention is easily associated with such cups, thereby making manipulation with the human hand relatively easy. This is especially imporant for small children or those having dexterity problems.

Almost everyone has encountered difficulties with disposable paper cups. Due to the frusto-conical sidewall, the top of the cup is larger than the bottom of the cup; this presents a situation where the cup may be easily tipped, thus spilling its contents. It is particular difficult for young children, who have still developing muscle-brain coordination, to be able to grasp the disposable paper cup without spilling the contents. In many instances, children must use two hands in holding the cup. An adult, on the other hand, may apply excessive pressure to the sidewall of the cup, thereby rupturing the cup or forcing some of the contents over the upper lip. In addition, an adult may brush his hand against the cup knocking it over and spilling the contents. In many instances, these disposable paper cups become too hot to touch or hold in the hand when they are filled with hot liquid, such as tea, coffee or soup.

The prior art has tried to overcome these difficulties by suggesting a variety of cup holders. In my co-pending application, I have described a cup holder having an upper expansible, collar-like portion to receive and retain therein, in a releasable friction-fit, a portion of the sidwall of the cup adjacent the upper expansible collar-like portion. In addition, there is disclosed a spaced, co-operating lower portion having an upper surface adapted to frictionally and releasably engaged and retain the bottom of the cup thereon. Between the upper expansible, collar-like portion and the lower extending support portion, there is an intermediate, depending, shank portion, outwardly spaced from the upper collar portion and the lower extending support portion.

In a particular embodiment of that invention, the cup holder has a releasable handle. In that particular embodiment, the releasable handle is a human figurine, with extending arms. On the palm surfaces of the extending hands are knobs or beads which fit into recesses in the expansible collar. At the foot portions of the figurine, there are recesses for receiving knobs or beads which are located on the upper surface of the lower support portion.

OBJECTS AND SUMMARY OF THE INVENTION

It is an object of the invention to provide a cup holder to receive and retain therein a cup.

It is another object of the invention to provide a handle for cooperative association with a cup to provide ease of grasping the same and to improve stability of the cup.

It is still another object of the invention to provide a cup holder that includes a readily releasable handle.

In an exemplary embodiment, the invention is directed to a cup holder for cooperative association with a cup, said holder comprising a cylinder and a releasable handle. The cylinder may be made of resilient plastic material adapted to receive and retain releasably therein a disposable cup. Extending outwardly from a portion of the upper lip of the cylinder and preferably integral with the cylinder itself is a ledge having one or more projections depending from the under surface. The ledge can extend around the upper rim of the cup but must be at best long enough to support one or more projections as needed.

On the bottom rim of the cylinder an interlocking tongue is provided by cutting two spaced notches into the rim. The interlocking tongue will generally be centered under the midpoint of the extending ledge on the upper rim; this increases the stability of the combination.

In this invention, the releasable handle comprises a shank, a lower platform and at least one extension on the upper portion of the shank. The shank is outwardly spaced from the ledge at the upper rim of the cylinder and terminates in a lower platform. The lower platform has a groove for receiving the interlocking tongue on the bottom rim of the cylinder. The upper portion of the shank has one or more extensions, the distal portion of which have means for releasably interlocking with one or more pegs or protrusions on the outwardly extending ledge at the upper lip of the cylinder. The extensions and the platform are substantially at right angles to the shank.

These and other objects of the invention will become more apparent from the hereinafter following commentary taken in conjunction with the following Figures of drawings.

A BRIEF DESCRIPTION OF THE DRAWINGS

DESCRIPTION OF THE BEST EMBODIMENTS CONTEMPLATED

Figure 1:
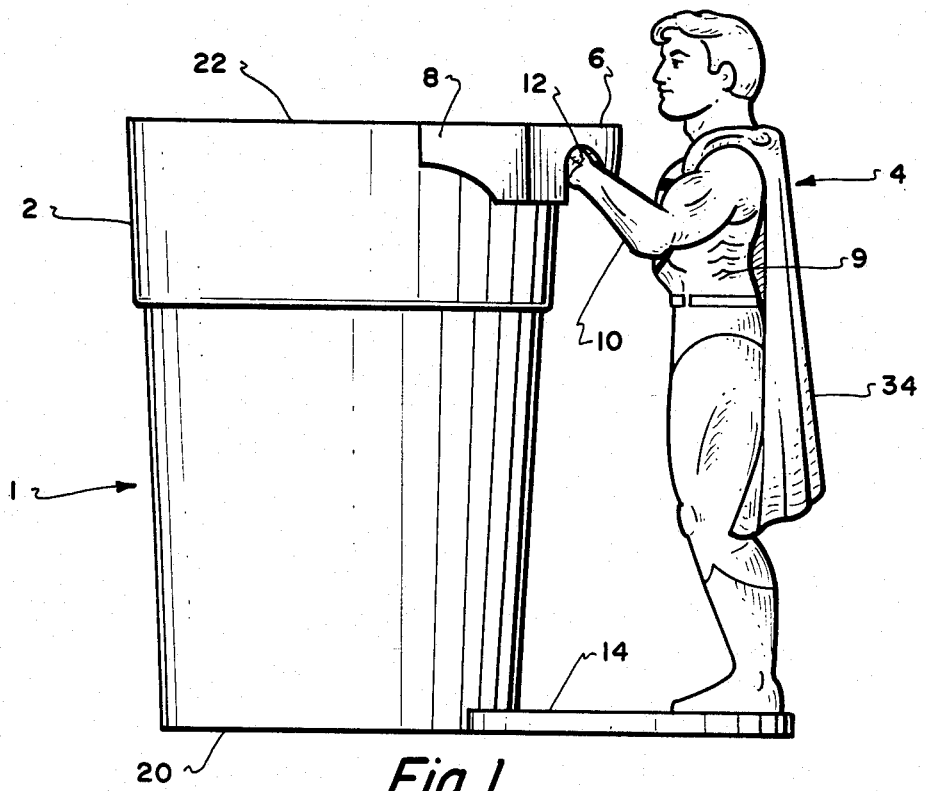
FIG. 1 is a side view of the invention with the shank portion of the handle illustrated as a figurine for illustrative purposes only.

In referring to the drawings, like numbers of reference designate like elements throughout, FIG. 1 illustrates a preferred embodiment of the invention. Cup holder 1 comprises two main portions, cylinder 2 and handle 4. Cylinder 2 will be shaped internally in a manner adapted to receive a disposable cup and will be substantially the same length as the cup. The cylinder 2 in FIG. 1 is frusto-conical in shape. Extending from a portion of upper rim 22 of cylinder 2 is ledge 6. Depending from the outer edge of ledge 6 is a skirt 8 which in this embodiment will hide from view the upper connection between cylinder 2 and handle 4.

Handle 4 in FIG. 1 is in the form of a figurine. Shank portion 9 is outwardly placed from cylinder 2 and is substantially parallel with the axis of cylinder 2. Left arm 10 of the figurine is extended forward, up and under ledge 6 through recess 12 in skirt 8. The figurine is standing on bottom platform 14.

Figure 2:
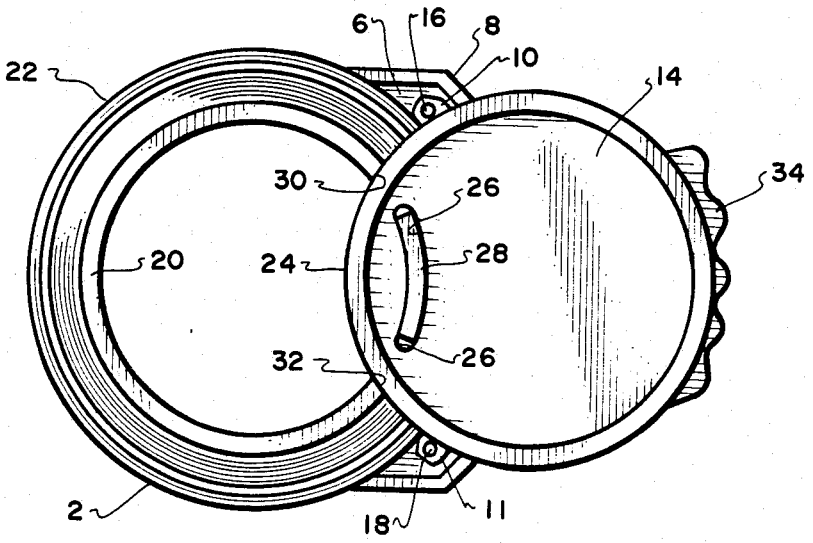
FIG. 2 is a bottom plan view of the invention showing the overlap between the cylinder and the lower platform.

FIG. 2 is a bottom plan view, showing cylinder 2, outwardly extending ledge 6, and skirt 8. The distal ends of arms 10 and 11 surround pegs 16 and 18 which depend from the under surface of outwardly extending ledge 6. Lower rim 20 and upper rim 22 of cylinder 2 are illustrated. Platform 14 partially overlaps the base of the cylinder 2 and thus provides an area 24 of platform 14 upon which the cup (not shown) will rest when inserted in cylinder 2. Groove 26 in platform 14 is designed to receive in a snug, but releasable fit, lip 28 of lower rim 20; lip 28 is the portion of the lower rim 20 defined by recesses 30 and 32. FIG. 2 also shows the lower edge of cape 34 of the figurine 4.

Figure 3:
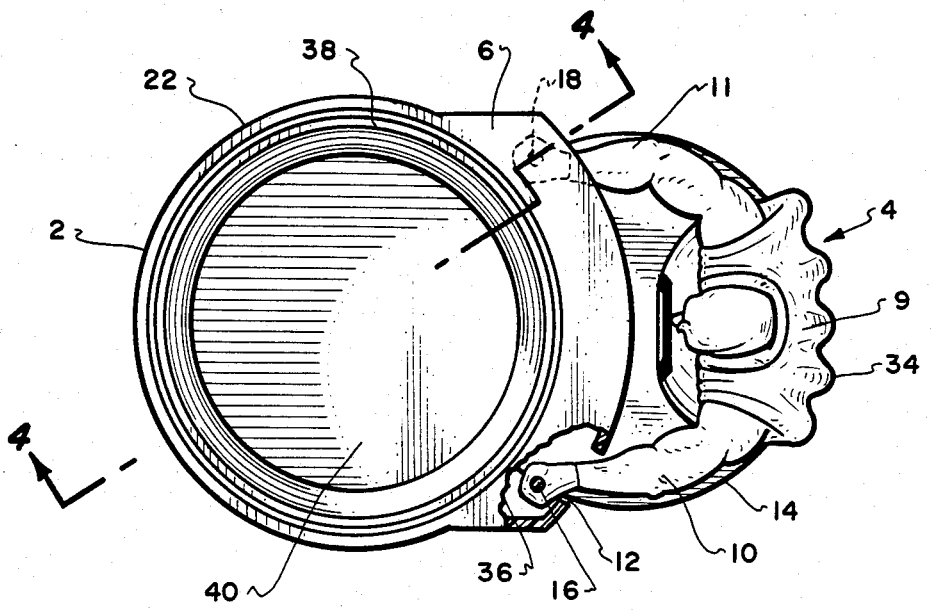
FIG. 3 is a top plan view of the invention with the handle in place, the handle being figurine-shaped for illustrative purposes only.

FIG. 3 is a top plan view of the present invention. Cylinder 2 with upper rim 22 and lower rim 20 are illustrated. In addition, inner annular ridge 38 is shown. If the cup to be used has a corresponding outer annular ridge, these mating surfaces will then provide greater stability for the cup. Outer extending ridge 6 is shown with cut-away section 36 overlying peg 16 and the distal end of arm 10 of the figurine. In contrast, the distal end of arm 11 and peg 18 are shown in phantom. The outer circumference of lower platform 14 is partially visible under figurine 4.

Figure 4:
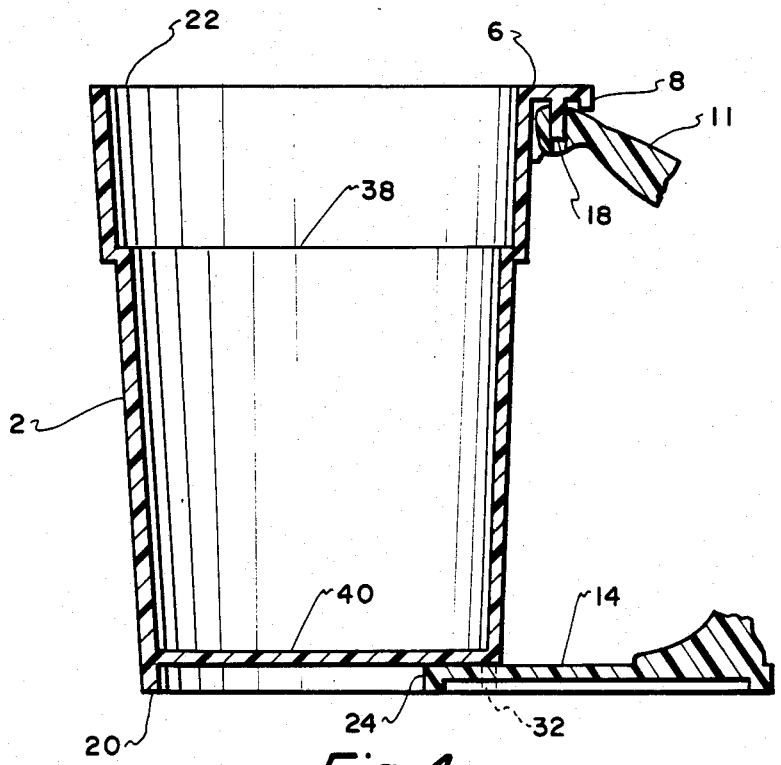
FIG. 4 is a cut away view, taken along the line 4—4 in FIG. 3.

FIG. 4 is a cut-away view along the lines 4—4 of FIG. 3. The major structures shown in this figure are part of cylinder 2 and lower platform 14. It also shows in more detail, the distal end of arm 11 partially grasping peg 18, and the relationship of arm 11, peg 18, outwardly extending ledge 6, and skirt 8. Lip 28 is shown in phantom extending through the lower platform 14. By extending through platform 14, lip 28 provides a greater degree of stability to the structure than it would if it terminated flush with the lower surface of platform 14. In this embodiment, cylinder 2 is closed by bottom 40.

In use, a cup (not shown) is inserted into cylinder 2 until the bottom rests on area 24 of lower platform 14 or bottom 40. The cup and its contents may now be held by grasping shank portion 9 of handle 4 which is shown in FIG. 1. When the cup is no longer wanted, it can be easily ejected by pushing against it through the opening at the bottom of cylinder 2 if it is open as in FIG. 2 or by simply up-ending cylinder 2 and letting it fall out. The holder is now ready to receive a new cup.

While a super hero figurine has been used to illustrate the invention, it is obvious that other characters may be utilized in forming handle 4. For example, sports figures of football, baseball, basketball and the like as well as other superhero-type characters may be employed. Additionally, caricatures may be utilized, such as a clown or animals, depending upon the end results desired.

In addition, while the invention has been described in the use of two arms extending from the figurine to interlock with two pegs under the extending ledge of cylinder 2, it should be understood that a single extension from the figurine or other handle can be employed provided that it properly interlocks with a peg or other protrusion under or on top of ledge 6. In general, however, two extensions, such as presently illustrated, provides more stability than a single fit would.

While the cup holder has been described as made of plastic, other suitable materials may be utilized. In addition, outwardly extending ledge 6 can be lower than upper rim 22, but for stability purposes, it should be close to the top of cylinder 2.

Those of ordinary skill in the art will at once recognize various changes and modifications to the specifically described embodiment of the invention.

The invention described above is susceptible of many variations and modifications, all are which are within the skill of the art. It should be understood that all such variations and modificatios are within the spirit and scope of the invention and of the appended claims. Similarly, it will be understood that it is intended to cover all changes and modifications and variations of the example herein disclosed for the purpose of illustration which do not constitute departures from the spirit and scope of the invention.

I claim:

1. A cup holder for co-operative association with a handleless cup comprising a cylinder and a releasable handle, said cylinder section having substantially the same length as a pre-selected cup and having substantially the same inner configuration as the outer configuration of said cup, a ledge extending outwardly from said holder at or near its upper rim, at least one protrusion on a horizontal surface of said ledge for releasably engaging corresponding receptacle means on an outwardly extending arm of a shank portion of said handle, said receptacle means being at the distal end of said arm, said shank portion depending from a proximal end of said arm and extending to a lower support platform, said platform extending substantially in the same direction as said arm and having means therein to releasably receive at its outer edge a portion of the bottom rim of said cup.

2. The cup holder in accordance with claim 1 wherein said shank portion has two outwardly extending arms, the distal portions of each having receptacle means to releasably engage corresponding protrusions on a horizontal surface of said ledge.

3. The cup holder of claim 2 wherein said protrusion are on the lower horizontal surface of said ledge.

4. The cup holder in accordance with claim 3 wherein the cylinder has an inwardly canted frustoconical sidewall adapted to receive and releasably retain therein a cup.

5. The cup holder of claim 3 wherein the handle is a figurine.

6. The cup holder of claim 5 wherein the bottom of the cylinder is closed.

7. The cup holder of claim 5 wherein the protrusions on said horizontal surface of said ledge are pegs and the receptacle means are each substantially in the form of a partially clenched fist

* * * * *